US005571048A

United States Patent [19]

Kenney

[11] Patent Number: 5,571,048

[45] Date of Patent: Nov. 5, 1996

[54] GOLF SWING PRACTICE DEVICE

[76] Inventor: Lawrence D. Kenney, 4 Park View Rd., Newton, N.J. 07860

[21] Appl. No.: 570,721

[22] Filed: Dec. 11, 1995

[51] Int. Cl.[6] ..... A63B 69/36

[52] U.S. Cl. ..... 473/228

[58] Field of Search ..... 273/26 B, 193 R, 273/194 R, 193 A, 186.2

[56] References Cited

U.S. PATENT DOCUMENTS

| | | | |
|---|---|---|---|
| 2,910,297 | 10/1959 | Bonetate | 273/162 R |
| 3,809,397 | 5/1974 | Gruenewald | 273/26 B |
| 4,416,451 | 11/1983 | Solloway | 273/26 B |
| 4,907,800 | 3/1990 | Passamaneck et al. | 273/26 B |
| 5,002,275 | 3/1991 | Beutler et al. | 273/193 A |
| 5,100,148 | 3/1992 | Smith | 273/193 A |
| 5,165,683 | 11/1992 | Beutler et al. | 273/193 A |
| 5,207,625 | 5/1993 | White | 273/193 A |
| 5,310,188 | 5/1994 | Hernberg | 273/193 A |
| 5,335,918 | 8/1994 | Rupnik et al. | 273/194 R |
| 5,395,107 | 3/1995 | De Pippo | 273/26 B |
| 5,415,406 | 5/1995 | Reichenbach et al. | 273/194 R |

*Primary Examiner*—Mark S. Graham

[57] ABSTRACT

A golf swing practice device consists of a plurality of plastic rigid wings which are attached to a golf shaft just above the ball-contacting head. The wings are effectively pre-designed airfoils, similar to airplane propellers, and they provide wind resistance during a swinging of the golf club. Additionally, the propeller-shaped wings cause a rotational torque to be exerted on the club so as to ensure proper club swing and rotation.

1 Claim, 3 Drawing Sheets

GOLF SWING PRACTICE DEVICE

BACKGROUND OF THE INVENTION

1. Field of the Invention

The present invention relates to golf training devices and more particular pertains to an attachment for a golf club which is designed to improve the swing of a golfer.

2. Description of the Prior Art

The use of golf swing training devices is well known in prior art. This is evidenced by the granting of a number of patents relating to various functional and structural aspects of such training devices. For example, U.S. Pat. No. 5,174,577, which issued to Warde et al. on Dec. 29, 1992, discloses a golf swing training device which provides both audible and tactile feedback to an individual during the swinging of a golf club. The device is designed to be attached to the golf club shaft just above the club head. Ideally, a golfer will come to recognize the desired sound produced by the golf club during a swing so as to achieve the best possible set of swing mechanics.

Another type of golf swing training device is shown in U.S. Pat. No. 5,209,482 which issued to Hopfer on May 11, 1993. The invention shown in this patent is designed to specifically develop certain muscle groups and techniques for golfers by utilizing a variable resistance means which may be attached to an object, such as door, and utilizes a simulated golf club to achieve a free-rotational movement of the user's limb or torso through a series of exercises.

While both of these prior art golf swing training devices are most likely quite functional for their intended purposes, neither teach the use of a device which could both improve a golfer's strength while teaching him the proper rotational mechanics required to achieve the most efficient golf swing form. As such, there appears to be a continuing need for such a combined training device and in this respect, the present invention substantially fulfills this need.

SUMMARY OF THE INVENTION

In view of the foregoing disadvantages inherent in the known types of golf swing practice devices now present in the prior art, the present invention provides a new golf swing practice device wherein the same can be utilized to both exercise the golfer while at the same time properly rotationally control the movement of the golf club during a swinging thereof. As such, the general purpose of the present invention, which will be described subsequently in greater detail, is to provide a golf swing practice device and method which has many of the advantages of the golf swing practice devices mentioned heretofore and many additional novel features that result in a golf swing practice device which is not anticipated, rendered obvious, suggested, or even implied by any of the prior art golf swing practice devices, either alone or in any combination thereof.

To attain this, the present invention generally comprises a golf swing practice device that consists of a plurality of plastic rigid wings which are attached to a golf shaft just above the ball-contacting head. The wings are effectively pre-designed airfoils, similar to airplane propellers, and they provide wind resistance during a swinging of the golf club. Additionally, the propeller-shaped wings cause a rotational torque to be exerted on the club so as to ensure proper club swing and rotation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf swing practice device and method which has many of the advantages of the golf swing practice devices mentioned heretofore and many novel features that result in a golf swing practice device which is not anticipated, rendered obvious, suggested, or even implied by any of the prior art golf swing practice devices, either alone or in any combination thereof.

It is another object of the present invention to provide a new golf swing practice device which may be easily and efficiently manufactured and marketed.

It is a further object of the present invention to provide a new golf swing practice device which is of a durable and reliable construction.

An even further object of the present invention is to provide a new golf swing practice device which is susceptible of a low cost of manufacture with regard to both materials and labor, and which accordingly is then susceptible of low prices of sale to the consuming public, thereby making such golf swing practice device economically available to the buying public.

Still yet another object of the present invention is to provide a new golf swing practice device which provides in the apparatuses and methods of the prior art some of the advantages thereof, while simultaneously overcoming some of the disadvantages normally associated therewith.

Still another object of the present invention is to provide a new and improved golf swing practice device which facilitates the use of a golf club to both exercise the golfer and at the same time train him with respect to proper rotational movement of a golf club during a swinging thereof.

Yet another object of the present invention is to provide a new and improved golf swing practice device which operates to simultaneously provide both an exercising and golf club control function.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF PREFERRED EMBODIMENT

Figure 1:
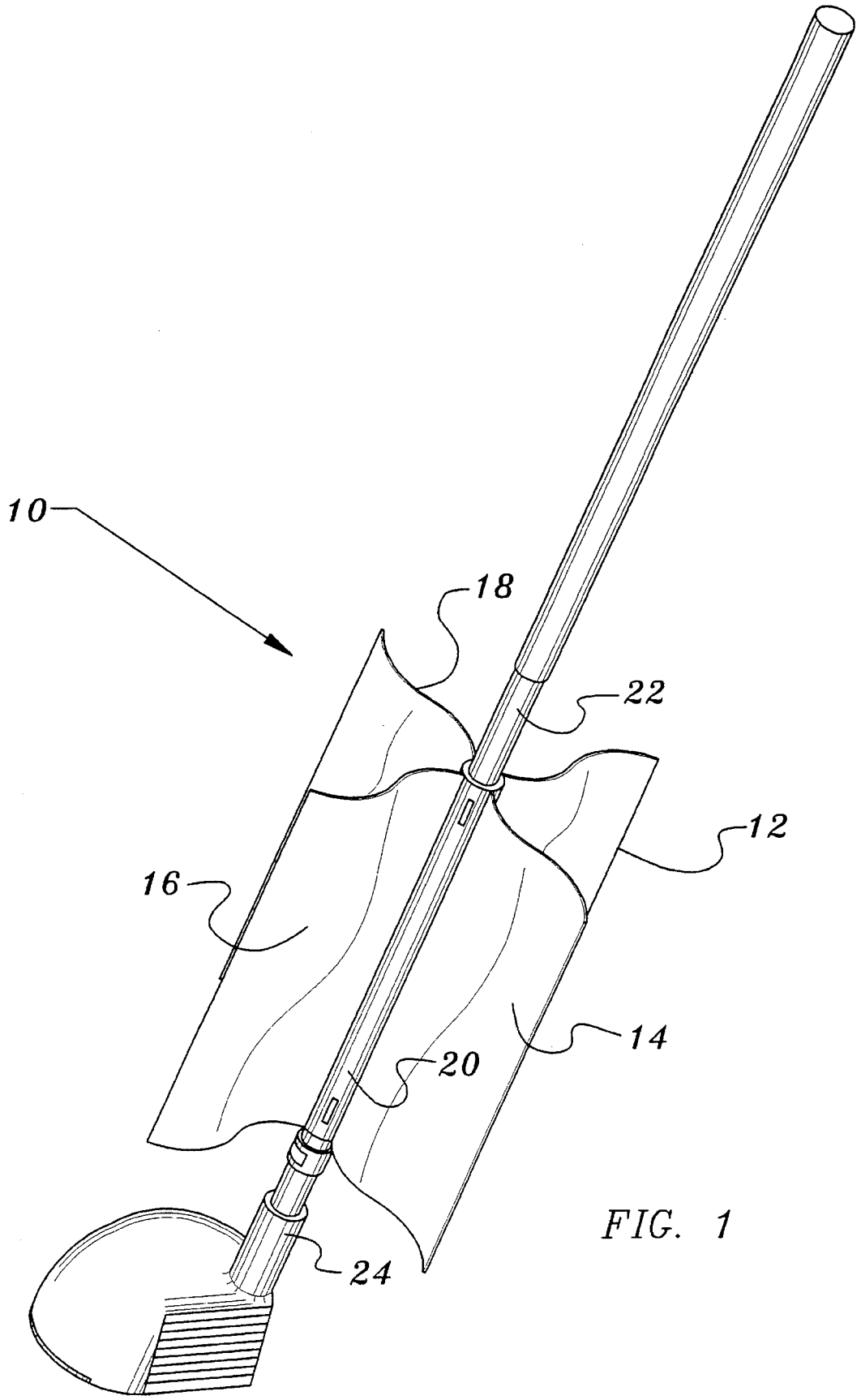
FIG. 1 is a perspective view of the invention showing it operably attached to a golf club.
Figure 2:
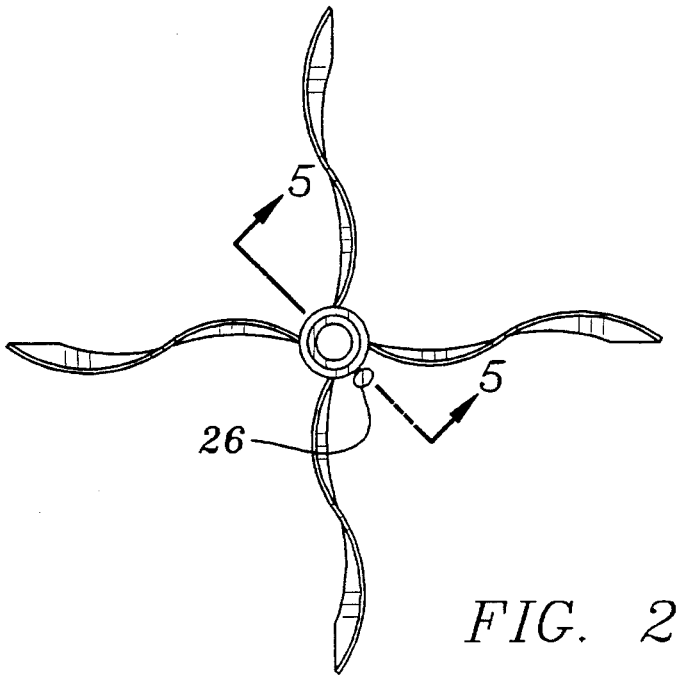
FIG. 2 is a top plan view of the invention.

With reference now to the drawings, and in particular to FIGS. 1 and 2 thereof, a new golf swing practice device embodying the principles and concepts of the present invention and generally designated by the reference numeral 10 will be described.

More specifically, it will be noted that the golf swing practice device 10 in its preferred form essentially comprises four contoured plastic wing members 12, 14, 16, 18. The plastic wings members are all fixedly secured to a cylindrical member 20 which is selectively removably attachable to a golf club shaft 22 just above the golf club head 24.

Various means can be utilized to attach the cylindrical member 20 to the golf club shaft 22. For example, in many cases a golf club head 24 can be threadably removed from a golf club shaft 22 whereby the cylindrical member 20 can then be slidably positioned over the golf club shaft. A thumb screw 26, which will be subsequently described in greater detail, is illustrated in FIG. 2 as one means of securing the cylindrical member 20 against further slidable or rotational movement on the golf club shaft 22 once the cylindrical member has been positioned where desired. By the same token, some golf club heads 24 are not threadably removable from a golf club shaft 22 and in those cases, the cylindrical member 20 could be axially split into two sections for positioning over the golf club shaft. Adhesives, threaded fasteners, or other any type of conventional attachment means could then be utilized to retain the two halves of the cylindrical member 20 in engagement around the golf club shaft 22 in a now apparent manner.

A novel feature of the invention 10 is the air foil or propeller-like shape of the individual wing members 12, 14, 16, 18. This predetermined scientific shaping of the wing members 12, 14, 16, 18 is illustrated in both FIGS. 1 and 2. Due to this shaping, the golf swing practice device 10 effectively accomplishes two very desirable functions for a golfer. More precisely, the golf swing practice device 10 operates to both exercise the golfer and to train him with respect to a proper rotational swing movement of the golf club 22 during a use thereof. In this regard, the exercising function is achieved by the wing members 12, 14, 16, 18 as a result of wind resistance being provided against the muscles of the golfer during a swinging of the club 22. The second function, i.e., the teaching of proper rotational movement of the golf club 22 during a swinging thereof, is achieved by the propeller-like behavior of the wing members 12, 14, 16, 18 whereby the wind passing over the wing members effectively forces a proper and controlled rotational movement of the golf club during usage. Thus, the golfer receives both a strengthening exercise and proper form and swing training when the golf swing practice device 10 is attached to the golf club 22.

Figure 3:
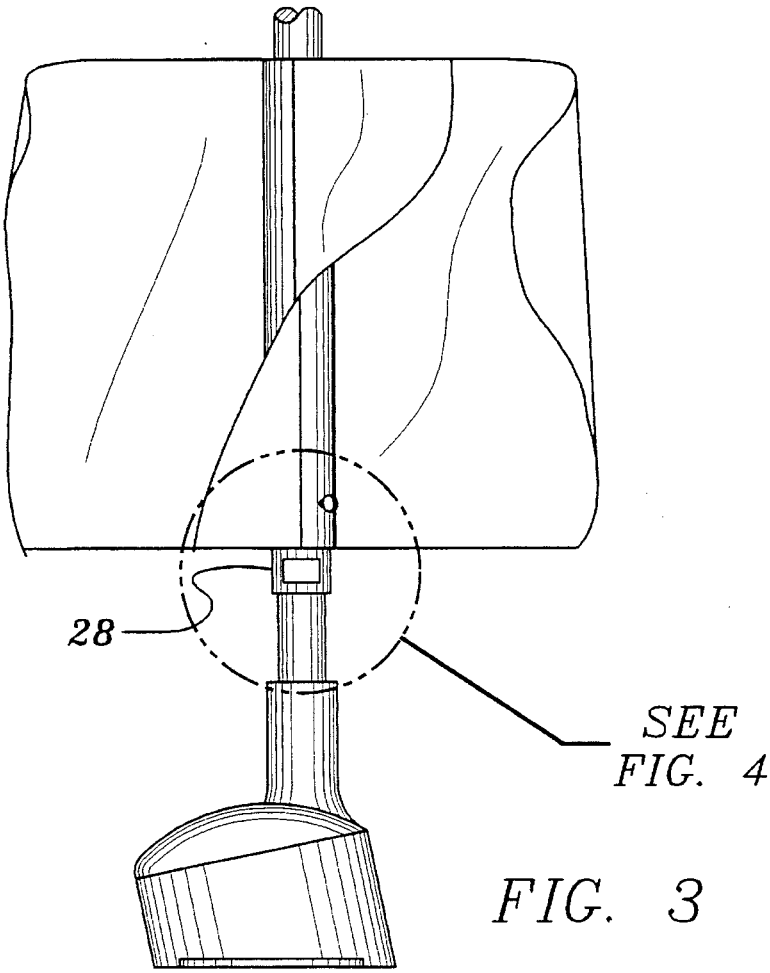
FIG. 3 is a front elevation view of the invention.
Figure 4:
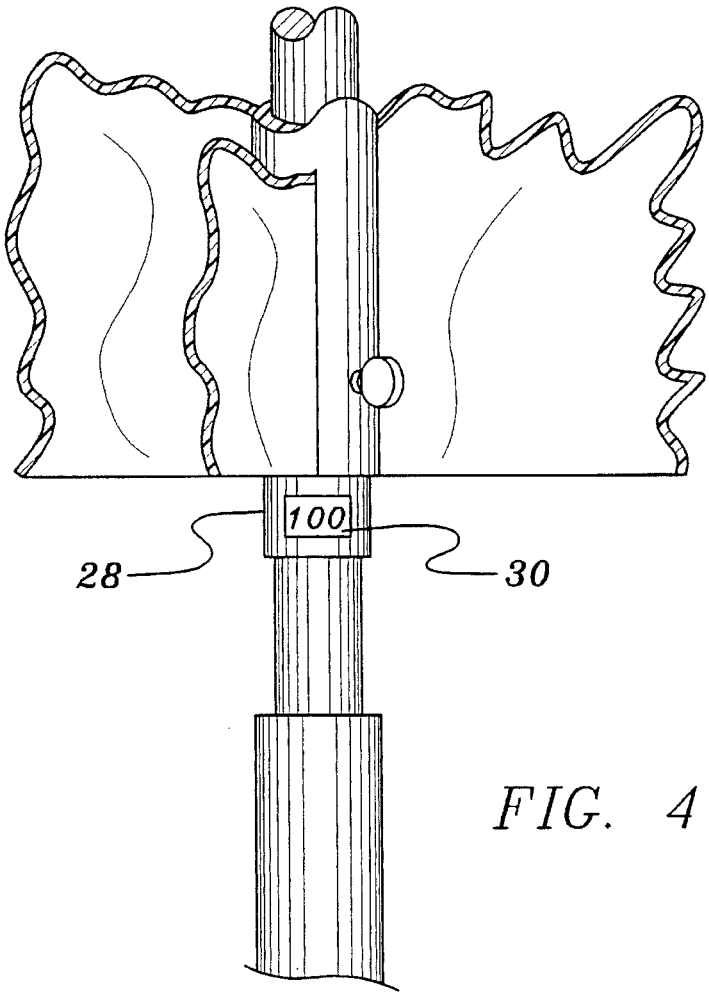
FIG. 4 is a detail view of the invention taken from FIG. 3 of the drawings.

FIGS. 3 and 4 illustrate another optional feature of the invention 10 wherein a golf swing speed sensor 28 is attached to the golf club 22 just below the golf swing practice device. The sensor 28 can take one of many forms and most likely would have to be used in conjunction with conventional speed sensing and measuring equipment. The sensor 28 could consist of a small circuit which includes a magnet, and such magnets can be tracked during movement by certain conventional electronic equipment. Ideally, the sensor 28 could also be provided with a display 30 whereby a golfer could view the display to see just how fast the golf club 22 has been swung. Devices of these types are available in the prior art and an example of their usage can be found with respect to the field of archery wherein arrow speed measuring devices provide similar information. As such, the concept of using such a speed measuring and displaying device on a golf club 22 is within the intent and purview of the present invention, although the specifics of how such a device 28 would operably function are not disclosed.

Figure 5:
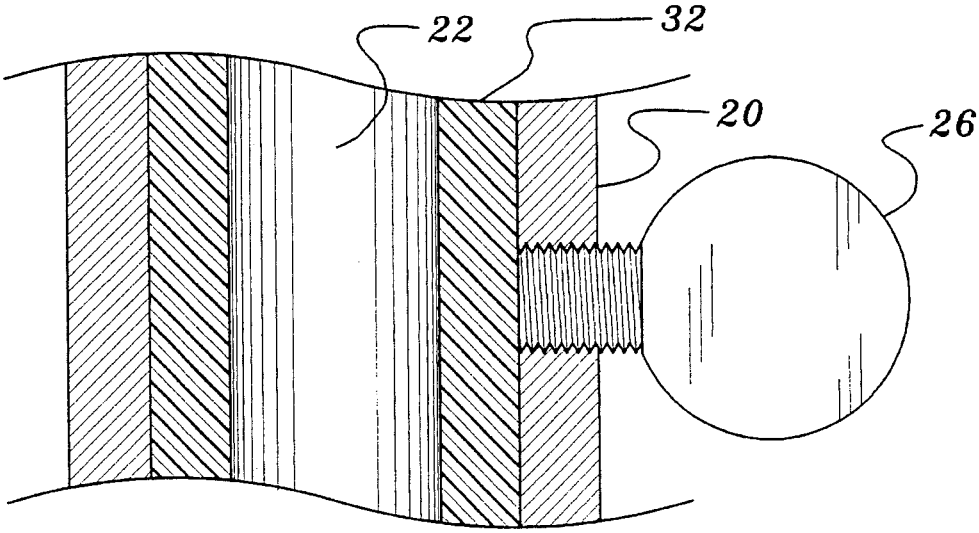
FIG. 5 is a cross-sectional view of the invention as viewed along the line 5—5 of FIG. 2.

FIG. 5 of the drawings has been provided to better illustrate one preferred attachment means for connecting the cylindrical member 20 to a golf club shaft 22. Typically, the cylindrical member 20 would be of a tapered construction to conformingly fit over the existing taper of a golf club 22 and, if a thumb screw 26 is utilized to lockably engage the cylindrical member to the golf club shaft, a protective polymeric sleeve 32 should be employed. The polymeric sleeve 32 is of a cylindrical design and is positionable between the cylindrical member 20 and the golf club shaft 22 as illustrated. The sleeve 32 could be formed from any known protective resilient material, such as polyurethane, rubber, or the like, and it will function to prevent abrasive and other types of damage to the golf club shaft 22. Inasmuch as it is desirable to keep the wing members 12, 14, 16, 18 of a somewhat lightweight construction, it is envisioned that they could be manufactured from a heavy-duty polyurethane or some similar rigid plastic. Similarly, if it is desired to increase the resistance of the golf club even further, thereby to provide an even greater exercising function, the wing members 12, 14, 16, 18 could be manufactured from a heavy metallic material. As such, the use of all such materials is well within the intent and purview of the present invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved golf swing practice device removably attachable to the shaft of a golf club comprising in combination:

a cylindrical member capable of being removably attached to a shaft of a golf club above a golf club head, the cylindrical member having a thumb screw for lockingly engaging the cylindrical member about the golf club;

an internal cylindrical sleeve being positionable between the shaft of the golf club and the cylindrical member, the sleeve serving to prevent abrasive damage to the shaft from the thumb screw being used to secure the cylindrical member to the shaft, the sleeve being formed of a polymeric material chosen from the group of polymeric material consisting of polyurethane and rubber; and at least four contoured wing members being fixedly attached to the cylindrical member when attached to the shaft, each wing member extending outwardly from the Shaft when attached to the cylindrical member, each wing having a curved shape like an airfoil and being predetermined for providing a wind resistance during golf swing practice, the four curved shaped wing members of the cylindrical member functioning together when positioned on the shaft for effecting a controlled rotational movement of the golf club during swinging thereof, the four curved shaped wing members being capable of effectively training a golfer with respect to required proper rotational movement of said golf club during use thereof on the shaft of the golf club.

* * * * *